United States Patent [19]

Yamashita et al.

[11] 4,267,248

[45] May 12, 1981

[54] MAGNET-BRUSH DEVELOPMENT PROCESS OF ELECTRIC PATTERN IMAGES

[75] Inventors: Keitaro Yamashita, Kodama; Ryuji Goto, Tokyo, both of Japan

[73] Assignee: Hitachi Metals, Ltd., Japan

[21] Appl. No.: 15,545

[22] Filed: Feb. 26, 1979

[30] Foreign Application Priority Data

Feb. 24, 1978 [JP] Japan ..... 53/20647

[51] Int. Cl.[3] ..... G03G 13/09; G03G 15/09

[52] U.S. Cl. ..... 430/122; 118/657

[58] Field of Search ..... 427/18; 118/657, 658; 430/39, 122; 355/3 DD

[56] References Cited

U.S. PATENT DOCUMENTS

| | | | |
|---|---|---|---|
| 3,152,924 | 10/1964 | Wanielista et al. | 427/18 |
| 3,455,276 | 7/1969 | Anderson | 427/18 |
| 3,703,395 | 11/1972 | Drexler et al. | 427/18 |
| 4,081,571 | 3/1978 | Nishihama et al. | 427/18 |

*Primary Examiner*—Morris Kaplan

*Attorney, Agent, or Firm*—Finnegan, Henderson, Farabow , Garrett & Dunner

[57] ABSTRACT

A magnet-brush development process in which the amount of developer powder supplied to a development zone is self-controllable by the rotation of a magnet roll. A permanent magnet member and the shell rotate at different speeds in the same direction in such a manner that developer powder, as a whole, is conveyed on the shell in the direction opposite to the rotation of the magnet roll from a doctor spacing of a developer vessel to an image-bearing material. By controlling the doctor spacing to be larger than the gap between the image-bearing material and the magnet roll, an accumulation of the developer powder occurs on the shell between the doctor spacing and the development zone and is kept to be substantially constant. At the accemulation, an understream of powder moves in the direction of roll-movement towards the powder supply.

14 Claims, 10 Drawing Figures

Fig. 2
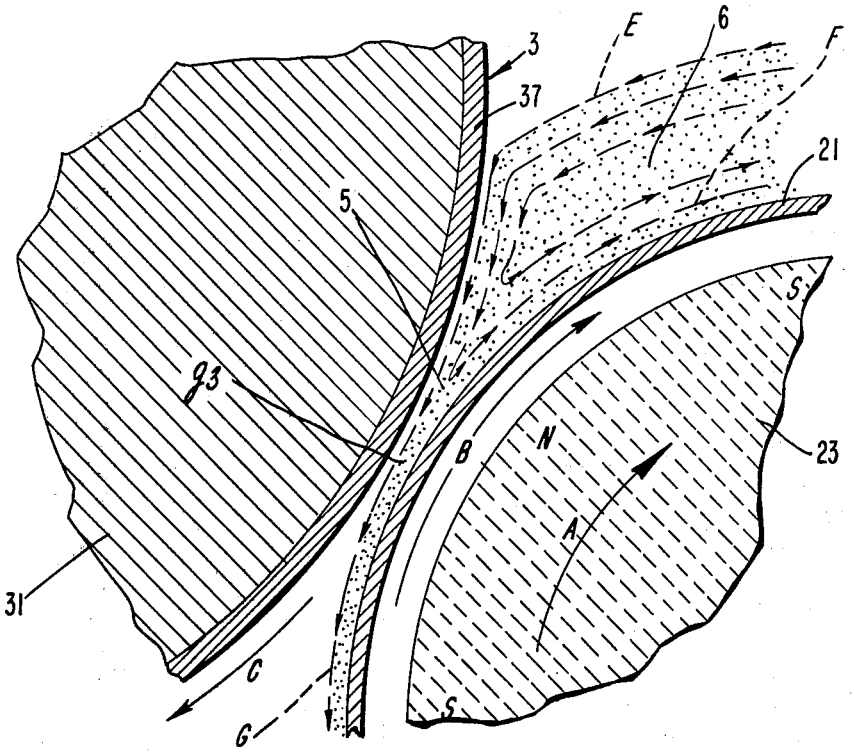
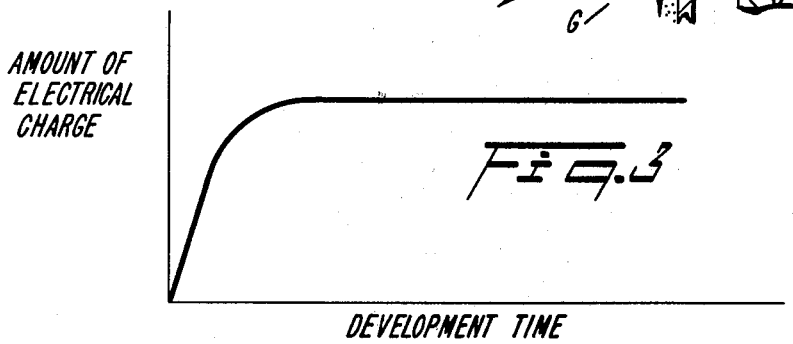
Fig. 3
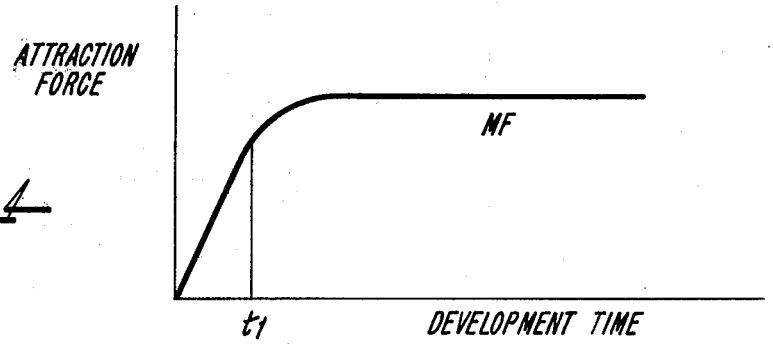
Fig. 4
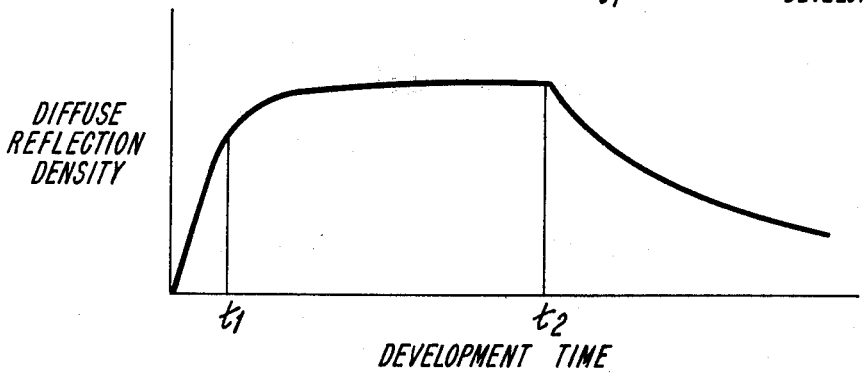
Fig. 5

MAGNET-BRUSH DEVELOPMENT PROCESS OF ELECTRIC PATTERN IMAGES

This invention relates to a magnet-brush development process of electric pattern images, and more particularly to a magnet-brush development process in which the amount of developer powder supplied to a development zone is self-controllable by the rotation of a magnet roll.

BACKGROUND OF THE INVENTION

In a magnet-brush development process, developer powder, which includes magnetic material, stored in a developer vessel is conveyed to a development zone and attracted to a magnet roll. Image-bearing material, positioned adjacent the magnet roll, may be composed of a highly resistive polyester sheet, photoconductive selenium, an electrically insulating film overlying a layer of photoconductive cadmium sulfide disposed in an insulating binder, a thin film of polyvinylcarbazole or poly-N-vinylcarbazole, a layer of the mixture of photoconductive zinc oxide and an insulating resin binder, or the like, as known in the art.

The developer powder is supplied from the developer vessel through a gap of predetermined size onto the magnet roll and, according to the rotation of the magnet roll, the developer powder rotates or tumbles along the roll to the development zone. At least at the development zone, the developer forms a magnet-brush on the magnet roll and the magnet-brush rubs the surface of the image-bearing material to adhere the toner material of the developer powder to electric pattern images on the surface. For purposes of this application, electric pattern images include electrostatic images, capacitive images, and electrically conductive images. For the convenience of explanation, the latent electrostatic images will be used as representative in this specification.

In the development, there has been used an admixture of ferromagnetic carrier particles and toner particles. The ferromagnetic carrier particles are resin-coated-iron beads and the toner particles are a mixture of pigment and binder. The carrier particles and the toner particles are triboelectrically charged to the opposite polarity by blending them. The materials of the carrier particles and the toner particles are selected to cause a charge on the toner opposite to the charge of the electrostatic latent image on the image-bearing material. The admixture is stored in the developer vessel in which the toner particles adhere to the surfaces of the carrier particles by the triboelectric charge and is then conveyed on the surface of the magnet roll as the roll rotates. The admixture forms a magnet-brush at the development zone and, when the brush rubs the latent image, the toner particles adhere to the latent image by the electrostatic attraction force between the charge of the latent image and the charge of the toner, but the carrier particles remain on the magnetic roll by the magnetic attraction force between the carrier and the roll. After the development the admixture, less the adhered toner, returns to the developer vessel and is supplied new toner.

On the other hand, a single component magnetic toner has been improved to be used in the magnet-brush development and has the advantage that it is not necessary to use the carrier particles or to mix them. Although such a magnetic toner is referred to as "single component" or "one component," the name does not mean that the toner consists of only one component, but the toner comprises mainly one kind of particles composed of fine magnetic particles, organic binder, pigment, carbon black and flow agents. No so-called "carrier" is required.

The structure of the magnet roll is well-known and is shown, for example, in Anderson, U.S. Pat. No. 3,455,276, Samuels et al, U.S. Pat. No. 4,003,334 and Yamashita et al, U.S. Pat. No. 3,828,730. Anderson refers to a magnet roll as a magnetically responsive powder applicator, which comprises a shaft of high magnetic permeability material, a plurality of elongate, generally sector-shaped in cross section, magnetic members formed of fine grain, permanent magnet material dispersed in a non-magnetic matrix, which members are positioned to define a circular array around the shaft, the alternate, outer faces of adjacent members being oppositely polarized, and a uniform non-magnetic hollow cylindrical sleeve positioned over the magnetic members and extending axially relative to the shaft. In Anderson the sleeve and the magnet members rotate relatively.

Samuels et al and Yamashita et al disclose the use of a one-body ceramic magnet, instead of elongate, generally sector-shaped in cross section, magnetic members formed of rubber magnet material. The Samuels et al magnet roll has an insulating sleeve or shell and Yamashita et al has two adjacent magnetic poles of the same polarity. In the magnet-brush development, it is necessary to make substantially constant the amount of the developer powder supplied to the development zone on the magnet roll for maximum clarity. In order to control the amount of the developer powder, a doctor blade is used close to an exit of the developer vessel and is positioned adjacent and in spaced relation to the magnet roll, forming a narrow spacing between the doctor blade and the shell surface of the magnet roll, hereafter called "doctor spacing." When the doctor spacing is narrower than the spacing between the shell surface and the image-bearing surface, the developer powder is not sufficient to develop the latent image on the image-bearing material. On the other hand, when the doctor spacing is broader than the spacing of the development zone, the developer powder tends to accumulate at the development zone and the accumulation grows with time. It is very important to the sensitivity of the development process to adjust the doctor spacing to control the amount of developer powder at the development zone.

By contrast, Nishihama et al, U.S. Pat. No. 4,081,571 proposes an electrostatic development method in which the minimum thickness of developer layer on a magnet roll is larger than the spacing between the magnet roll and the image-bearing material to form a developer accumulation, or reservoir zone, of the developer powder upstream of and adjacent the development zone. According to Nishihama et al, a roll-like permanent magnet of the magnet roll rotates in the opposite direction to the rotating direction of a developer-carrying member, such as a cylindrical, non-magnetic shell, of the magnet roll so that the developer powder in the reservoir is magnetically disturbed. Furthermore, since the reservoir of the developer powder is growing larger with time, at the end of every developing cycle, the developer powder in the reservoir should be carried away by the developer-carrying member, or a drum-shaped image-bearing member should have a groove of a relatively small diameter at a position of the surface of the image-bearing member to allow the reserved developer powder to pass through on a cyclic basis. The change of the amount of the developer powder in the development zone tends to cause developed images to be uneven.

SUMMARY OF THE INVENTION

It is, therefore, an object of this invention to improve processes for developing electric pattern images on an image-bearing member with developer powder including magnetic material, which is free from the defects of the prior art developing processes described above.

Another object of this invention is to provide a developing process in which a contact area of developer powder with one surface of image-bearing material is kept substantially constant to develop electric pattern images excellently and stably on the image-bearing material.

A further object of this invention is to keep substantially constant an accumulation of developer powder at a development zone of an image-developing process and to maintain a contact of the accumulation of developer powder with the surface of the image-bearing material for a period sufficient to allow an attraction force between toner material of the developer powder and the electric pattern images to adhere the toner material to the images.

A still further object of this invention is to prevent a rapid movement of the developer powder at a development zone of an image-developing process.

According to this invention, these objects are accomplished by a process for depositing toner material on electric pattern images formed on an image-bearing material, which comprises the steps of:

providing a magnet roll and a doctor blade, the magnet roll including a cylindrical rotatable shell of non-magnetic material and a rotatable permanent magnet member positioned coaxially within the shell, the doctor blade being positioned adjacent, and forming a first spaced gap with, the shell;

positioning material having a surface bearing electric pattern images adjacent, and forming a second spaced gap with, the shell;

supplying developer powder containing magnetic material on the surface of the shell through the first gap;

rotating both the shell and the permanent magnet member in the same direction; and adjusting the relative rotational speeds of the permanent magnet member and the shell and the relative sizes of the gaps for causing a contacting area of the developer powder on the shell with the image-bearing surface to be substantially constant to adhere the toner material of the developer powder onto the electric pattern images for developing the electric pattern images.

In this invention, the step of adjusting the relative rotational speeds of the permanent magnet member and the shell and the relative sizes of the gaps includes the step of rotating the shell and the permanent magnet member at differential speeds for transporting the developer powder on the shell, as a whole, to the second gap at the substantially same rate as the flow of the developer powder into the second gap.

It is preferable in this invention that the first gap be made larger than the second gap to cause an accumulation of the developer powder on the shell between the gaps resulting in a circulation of the accumulation wherein a surface portion of the developer powder in the accumulation flows in the opposite direction to the rotation of the shell and magnet member and a lower portion of the developer powder in the accumulation flows in the same direction as the rotation of the shell and magnet member.

It is also preferable that the circulation of the accumulation is adjusted by the relative rotational speeds of the magnet and the shell for maintaining the contact of the developer powder with the surface of the image-bearing material for a period sufficient to allow an attraction force between the toner material of the developer powder and the electric pattern images on the surface to adhere the toner material to the images.

It is desirable that the surface of the image-bearing material moves in the with-mode to the flow of the surface of the developer powder at the point of contact of the image-bearing material with the accumulation of developer powder.

For accomplishing this invention, the permanent magnet member may have a rotatable shaft mounted coaxially with the shell and a cylindrical permanent magnet secured to the shaft and the cylindrical permanent magnet may have a plurality of adjacent axially extending magnetic poles of alternating polarity on the peripheral surface of the magnet. The number of the poles is preferably at least eight. The magnetic flux density due to the cylindrical permanent magnet may be at least 500 gauses on the shell surface.

The shell of the magnet roll may be electroconductive material, such as stainless steel, aluminum alloy and the like.

The image-bearing material may be supported by an electroconductive backing plate on the opposite surface of the image-bearing material to the surface on which the images exist. The electroconductive backing plate and the electro-conductive shell may be electrically connected and grounded. Alternatively, between them an electrical potential may be applied.

It is preferable in this invention to use single component magnetic toner as the developer powder. The magnetic toner may be electrically conductive, having an electric conductivity ranging between $10^{-2}$ mho.cm in a D.C. electrical field of 30 volts/cm and $10^{-5}$ mho.cm in a D.C. electrical field of 400 volts/cm. Alternatively, the magnetic toner may be highly resistive, having an electric conductivity ranging between $10^{-8}$ and $10^{-14}$ mho.cm in a D.C. electrical field of 10,000 volts/cm.

To practice this invention, a second doctor blade may be positioned adjacent and in spaced relation to the shell between the first doctor blade and the image-bearing material to adjust the amount of the developer powder to be supplied to the image-bearing material. The distance between the second doctor blade and the shell is preferably smaller that the first gap to accumulate the developer powder on the shell surface between the doctor blades.

The above and other objects and advantages of this invention will become more apparent from the following description taken in conjunction with the accompanying drawings.

BRIEF DESCRIPTION OF THE DRAWINGS

FIG. 2 is an enlarged cross-sectional view for explaining the flow of developer powder;

FIG. 3 is a graph of a plot of the electrical charge induced in the developer powder versus development time in the process of this invention;

FIG. 4 is a graph of the attraction force between the developer powder and the latent images versus development time;

FIG. 5 is a graph of a plot of the diffuse reflection density of a developed solid area versus development time;

DETAILED DESCRIPTION OF PREFERRED EMBODIMENTS

Figure 1A:
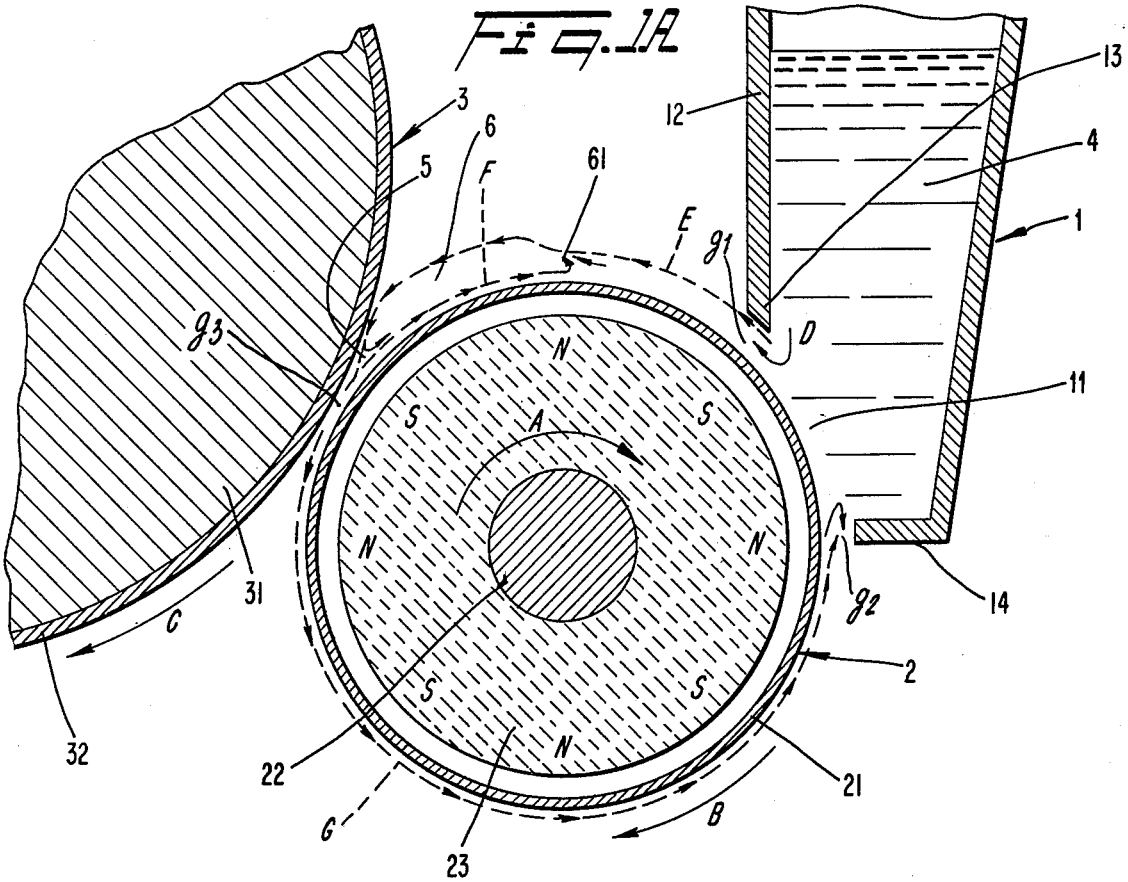
FIGS. 1A and 1B are simplified cross-sectional views illustrating the principle of this invention.
Figure 1B:
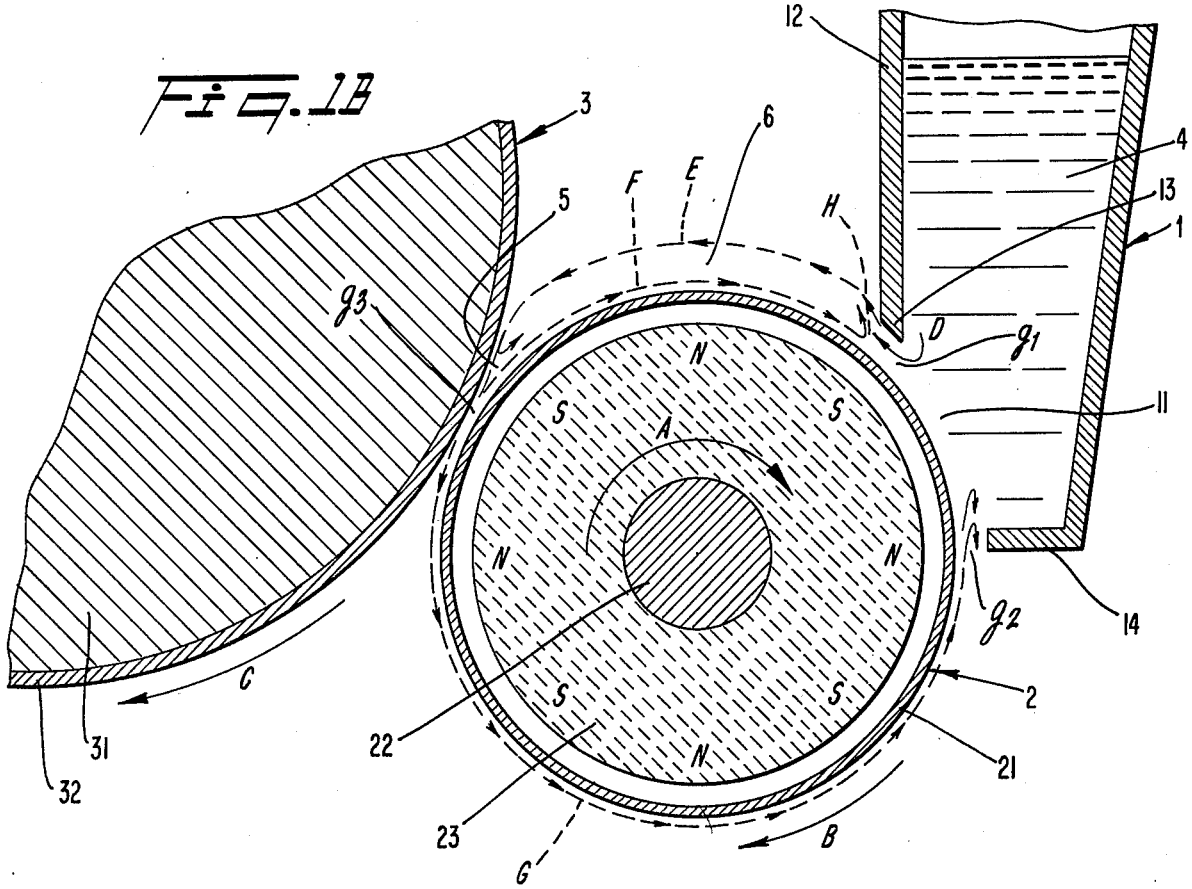
Figure 9:
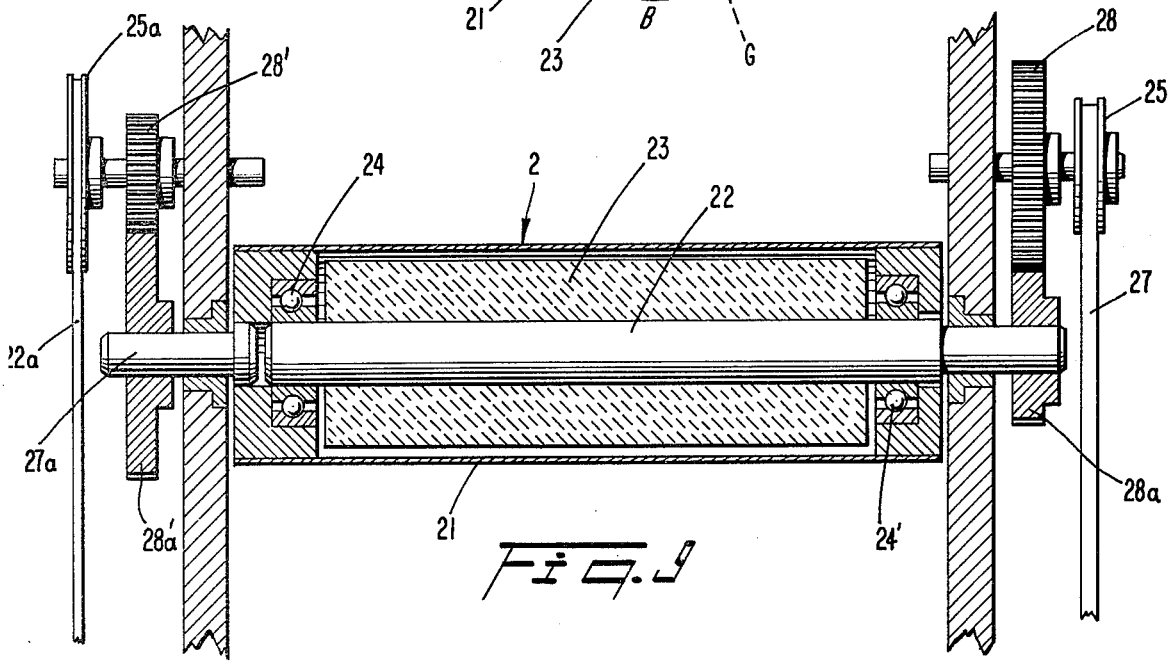
FIG. 9 is a longitudinally cross-sectional view of a magnet roll usable in the process of this invention.

Referring now to FIGS. 1A, 1B and 9, developer vessel 1 stores developer powder 4 which should be magnetically attractable, such as an admixture of ferromagnetic carrier particles and toner particles, or a single component magnetic toner. The vessel 1 has an opening 11 at its lower portion and a side wall 12 constituting a doctor blade 13 at one end of the wall. A magnet roll 2 projects slightly into the toner vessel 1 at the opening 11.

The magnet roll 2 includes a rotatable non-magnetic, cylindrical shell 21 and a rotatable permanent magnet member incorporated coaxially in the shell 21. The rotatable permanent magnet member includes a shaft 22 mounted at the axis of the shell 21 and a cylindrical permanent magnet 23 secured around the shaft 22. The permanent magnet 23 has a plurality of adjacent axially extending magnetic poles N, S of alternating polarity on its peripheral surface. In the drawing, N and S mean a north pole and a south pole, respectively. The shaft 22 is journaled at both ends by bearing members 24, 24' with the shell 21, and the shell 21 and the shaft 22 are driven independently by a motor (not shown).

In FIG. 9, a pulley 25 and a gear 28 are rotated by a motor (not shown) through a belt member 27. The rotation of the gear 28 is transmitted to the shaft 22 through a gear **28*a* to rotate the permanent magnet 23. The shell 21 is rotated by a belt 27*a* which transmits a rotation through a pulley 25*a*, gears 28', 28*a'* and a shaft 22*a* to the shell 21. In such a manner, the shell 21 and the permanent magnet 23 rotate independently in the same direction at different speeds. For purposes of illustration the shaft 22 and the permanent magnet rotate clockwise, i.e., in the direction shown by an arrow A and the shell 21 rotates in the direction shown by an arrow B, i.e., in the same direction as that of the magnet 23**.

The magnet roll 2 is positioned so as to form a doctor spacing g1 between the doctor blade 13 and the surface of the shell 21 and another spacing g2 between the shell 21 and the edge of the bottom plate 14 of the developer vessel 1. The doctor spacing g1 and the spacing g2 are preferably adjustable to control the developer amount to be conveyed and to prevent the leakage of developer powder on the supplying of new developer powder to the developer vessel 1.

An image-bearing member 3, formed in a drum shape, comprises a cylindrical electroconductive support 31 and image-bearing material 32 deposited on the peripheral surface of the electroconductive support. The image-bearing material 32 may be composed of a high resistive polyester film, a photoconductive selenium, an electrically insulating film overlying a layer of photoconductive cadmium sulfide disposed in an insulating binder, a thin film of polyvinylcarbazole or poly-N-vinylcarbazole, a layer of the mixture of photoconductive zinc oxide and an insulating resin binder, or the like.

The image-bearing member 3 is juxtaposed with the magnet roll 2 and forms a small gap g3 at the point where the member 3 is opposite the shell 21. The member 3 may rotate clockwise or counter-clockwise, but preferably the member 3 rotates in the direction as the magnet and shell, i.e., clockwise as shown by an arrow C in the illustrations.

An electrostatic latent image is formed on the image-bearing material in a well-known manner. For example, when a zinc oxide coated paper is used as the image-bearing material, the paper is uniformly charged negatively by a corona charger to have −800 volts and is exposed to a light pattern to be duplicated. By the exposure, electrostatic latent images are formed, having higher charged portions of −750 volts and lesser charged portions of −50 volts. Then, the electric charge pattern is developed positively or negatively by rubbing the surface of the image-bearing material with developer brush formed of developer powder on the magnet roll 2 at the development zone 5.

By this invention, the shell 21 and the permanent magnet 23 of the magnet roll 2 rotate in the same direction while the relative rotation speeds of the shell 21 and the permanent magnet 23 are controlled for transporting the developer powder on the shell 21, as a whole, counterclockwise on the shell 21 from the developer vessel 1 to the development zone 5 at the same speed as the developer powder flows into the gap g3 as explained hereinafter.

When the doctor spacing g1 is fixed to be larger than the gap g3 at the development zone 5, the amount of the developer powder which passes through the gap g3 may be smaller than that which is supplied through the doctor spacing g1 from the developer vessel 1, so that the developer powder causes gradually a developer accumulation 6 on the shell 21. The accumulation 6 grows with time and at last covers the region on the shell 21 from the development zone 5 to the doctor blade 13, as shown in FIG. 1B.

According to this invention, a contacting area of the developer powder on the shell 21 with the surface of the image-bearing material is kept substantially constant because, once the developer accumulation has been formed, the accumulation is kept constant by the process of the invention.

If the shell 21 were to be held stationary and the magnet 23 rotates clockwise, as shown by the arrow A, the developer powder tumbles between the magnetic poles of the permanent magnet and is conveyed counterclockwise as shown by an arrow E. The transporting speed depends on the thickness of the layer of the developer powder on the shell, the coefficient of friction of the shell surface, the number of the magnetic poles and the rotation speed of the magnet. If the friction is negligible, the transporting speed is approximately expressed by the equation:

$$N \cdot \frac{f}{60} \cdot t \text{ (mm/sec)},$$

wherein N is the number of magnetic poles, f is the rotation speed in r.p.m. and t is the thickness. The friction operates negatively to the transporting movement, i.e., it tends to reduce the transporting speed.

On the other hand, if the magnet 23 were to be held stationary and the shell 21 rotates clockwise, as shown by the arrow B, the developer powder is attracted to the shell surface because of the magnetic attraction force of the permanent magnet 23 and is conveyed clockwise, as shown by the arrow F at the speed of the surface of the shell 21.

When the magnet 23 and the shell 21 are both rotated in the same direction, however, an accumulation of developer powder tends to circulate between the gaps g1 and g3, the surface of the accumulation moving counterclockwise in a direction opposite to the direction of the rotation of the magnet and shell, and the developer powder on and near to the shell being dragged along clockwise by the frictional contact with the shell.

The relative rotation speeds of the shell 21 and the permanent magnet 23 may be adjusted so that the developer powder is, as a whole, conveyed counterclockwise while both the shell 21 and the magnet 23 rotate clockwise.

The accumulation 6 of the developer powder depends on the feeding speed of the developer powder through the doctor spacing g1, the width of the gap g3, the friction of the shell surface, the surface speed of the shell and so forth.

Since the rotation of the magnet 23 tends to tumble the developer powder, when the accumulation 6 starts occurring, a clockwise counter-flow also starts to occur, and a part of the developer powder which has reached to the development zone 5 is drawn down adjacent the surface of the shell 21 and flows along the shell surface in the direction of the arrow F. The counter-flow of the developer powder gives an understream of the developer flow and collides with the normal flow E at the point 61 near the doctor spacing g1, at which the developer powder is supplied from the developer vessel 1, and tends to interrupt the supply.

By the interruption, the developer supply through the gap g1 is reduced and the developer powder in the accumulation 6 is reduced by consumption for development and passage through the gap g3. Once the reduction of the accumulation starts, the collision point 61 retreats from the gap g1, so that the developer supply tends to increase. Through these processes, the supply, the consumption and the transport G of the developer powder are balanced and the amount of the accumulation is stable during the operation of the apparatus.

In FIG. 2, the image-bearing material 32 contacts the developer powder at the left end of the developer accumulation 6. As explained above, the accumulation is kept substantially constant so that the contact area is kept substantially constant. As the image-bearing member 3 rotates at a given speed, the constant contact area causes a given contact time. Since the latent images are developed during the contact time, the stable contact time causes good quality of developed image with high density. A stable contact time is most critical during development by a single component toner.

The single component magnetic toner is usually composed of binder component, carbon-black and magnetite. Just before the development, the single component magnetic toner is charged in the opposite polarity to the latent image by induction or polarization through a conductive shell, or another electrode when an insulating shell is used.

The amount of the charge on the single component toner depends on the development time. As shown in FIG. 3, the amount of charge has an exponential relation with the time. After the toner reaches the surface of the image-bearing material at which an electrostatic latent image has a charge pattern, the toner starts to receive an electrical charge of the opposite polarity and the charge increases during the contact of the toner with the charge pattern as plotted in FIG. 3.

At the same time, the attraction force between the toner and the charge pattern increases as plotted in FIG. 4, since the attraction force depends on the amount of the electrical charge in the toner. Although the attraction force becomes large enough to start attracting the toner to the latent image in a short time, if the contact time is too short, the toner will not develop enough charge to overcome the magnetic attraction force due to the permanent magnet. When the magnetic attraction force of the permanent magnet is at a level of MF, as in FIG. 4, the toner can adhere to the latent image only after the time of t1 in which the charge on the toner is increased beyond the level of MF.

By contrast, if the time is too long, the toner adhered to the latent image will tend to lose its charge by leakage or neutralization with the charge of the latent image or by contact with other toner particles and will be removed partially from the latent image so that the developed image will be degraded.

FIG. 5 shows a graph of a plot of the diffuse reflection density, i.e., degree of blackness, of a developed solid area versus development time. After the time of t2 elapses, the diffuse reflection density reduces rapidly.

By the process of this invention, the contact area is kept substantially constant by the stable accumulation so that the development time can be kept constant for the necessary period for the maximum development of the latent image.

This invention has another advantage in the development. The surface flow of the developer accumulation 6 is in a determined direction, i.e., counterclockwise as illustrated in FIG. 2, so that the developer powder, which is contacting the image-bearing material, i.e., the surface portion of the accumulation, flows in one direction and does not cause disturbance which removes from the image-bearing material the developer powder which has adhered to the material.

In the accomplishment of this invention, as explained above, a single component magnetic toner may be used as the developer powder. The single component magnetic toner may be electrically conductive, having an electric conductivity ranging between $10^{-2}$ mho.cm is a D.C. electrical field of 30 volts/cm and $10^{-5}$ mho.cm in a D.C. electrical field 400 volts/cm. When using the electrically conductive toner in this process, an electrically insulating shell may be used. The toner is suitable for a coated paper copier.

On the other hand, a single component highly resistive magnetic toner may be used in this process and it has an electric conductivity ranging between $10^{-8}$ and $10^{-14}$ mho.cm in a D.C. electrical field of 10,000 volts/cm. An electrically conductive shell is suitable with the highly resistive toner. The highly resistive toner is particularly suitable for plain paper copier because the highly resistive toner has an excellent charge retention property so that, since the toner does not tend to lose its charge, the toner adhered to the image-bearing material is easily transferred to another sheet, such as plain paper, by applying an electrical potential on the adhered toner.

Figure 6:
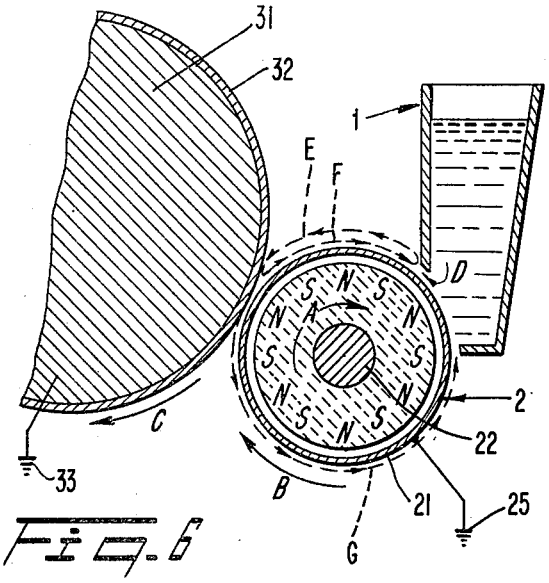
FIG. 6 is a schematic cross-sectional view of an embodiment of apparatus for accomplishing a process of this invention.
Figure 7:
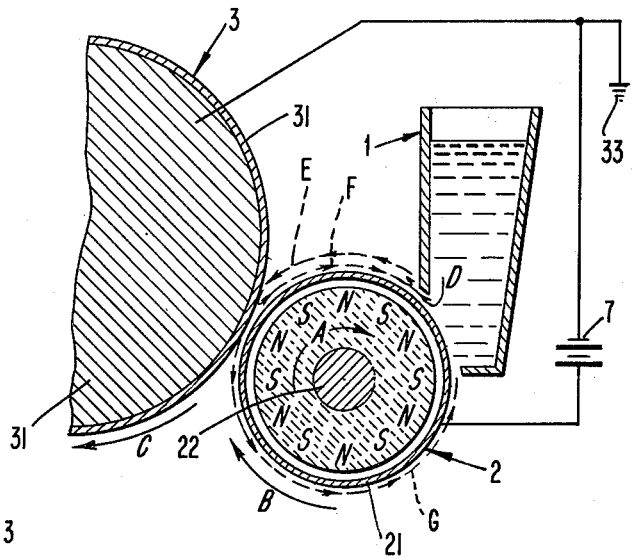
FIG. 7 is a schematic cross-sectional view of another embodiment of apparatus for accomplishing a process of this invention.
Figure 8:
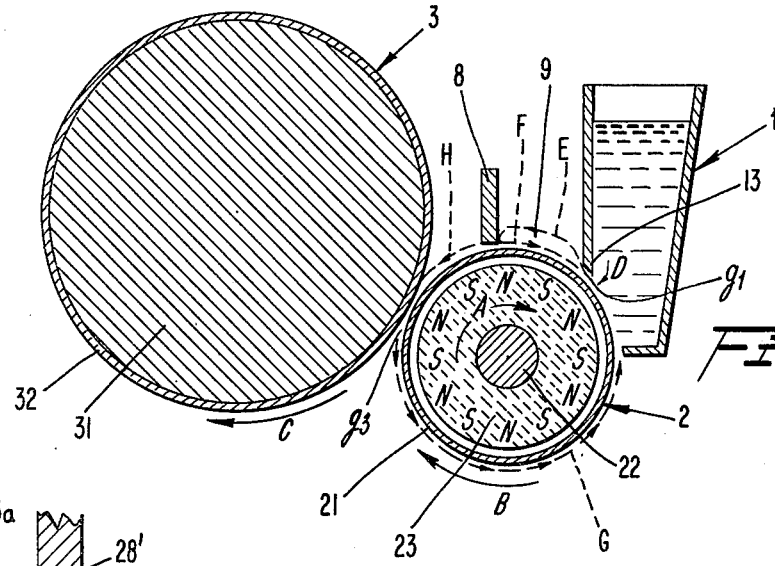
FIG. 8 is a schematic cross-sectional view of a further embodiment of apparatus for accomplishing a process of this invention.

In the accomplishment of this invention, the apparatuses shown in FIGS. 6 to 8 may be used. In FIG. 6, an electrically conductive shell 21 of a magnet roll 2 is positioned adjacent, and in spaced relation to, a cylindrical image-bearing member 3. The member 3 has a cylindrical electroconductive support 31. Both the electrically conductive shell 21 and the electroconductive support 31 are connected to earth 25 and 33.

In FIG. 7, an electroconductive support 31 is connected to earth 33 but the electrically conductive shell 21 is biased by a D.C. potential source 7. The varying of the potential 7 adjusts the adherence of the developer powder to the electric image pattern.

The apparatuses of both FIGS. 6 and 7 are suitable for highly resistive magnetic toner.

The apparatus shown in FIG. 8 has a second doctor blade 8. The distance between the second doctor blade 8 and the shell 21 is adjusted to be less than the first doctor spacing g1 and larger than the gap g3. By using the second doctor blade 8, it is possible to make the development time short. The accumulation between the second doctor blade 8 and the image-bearing member is smaller than the accumulation 9 between the second doctor blade and the first doctor blade 13 so that the contact area of the developer powder with the image-bearing material is rather small. This apparatus is suitable for the highly conductive toner because the highly conductive toner can obtain the induced charge in a short time.

In the accomplishment of the process of this invention, a ceramic permanent magnet, or a rubber or plastic permanent magnet, may be used as the cylindrical permanent magnet. The ceramic permanent magnet may be a barium ferrite magnet, a strontium ferrite magnet or a barium-strontium ferrite magnet. The rubber or plastic permanent magnet may be composed of synthetic rubber such as chloroprene-rubber and barrium ferrite powder dispersed throughout the rubber.

Usually, the permanent magnet is formed in a cylindrical shape having a diameter of 25 to 40 millimeters and a length of 150 to 500 millimeters. But the size is determined according to a paper size on which a developed image will be. The magnet is magnetized to have the magnetic poles symmetrically arranged on the peripheral surface of the magnet. The number of the magnetic poles is determined from the standpoint of transportation speed of the developer powder. The magnet should have at least four poles, but it is preferable that the magnet has at least eight poles in order to convey the developer powder against the movement of the shell.

The magnetic flux density should be at least 500 gausses on the shell surface. An isotropic barium ferrite magnet of 29.3 millimeter diameter and 203 millimeter length having twelve poles exhibits about 550 gausses on a stainless shell of 31.4 millimeter outer diameter. An anisotropic barium ferrite magnet of 29.3 millimeter diameter and 250 millimeter length having eight poles exhibits about 1,100 gausses on a stainless shell of 31.4 millimeter outer diameter.

Although the rotation speed can be chosen to obtain a desirable transporting speed and a desirable amount of accumulation of the developer powder, it is preferable to rotate the magnet at a rate of 500 to 1,500 r.p.m.

The shell rotates at a slow rate in comparision with the rotation speed of the magnet. It is preferable to rotate the shell at a surface speed of 30 to 60 millimeters per second.

The image-bearing member may rotate clockwise or counterclockwise. In the drawings, the member rotates clockwise and contacts the developer powder in "with-mode." The member may contact the developer powder in "against-mode." The "with-mode" contact is more preferable than the "against-mode" contact because the "with-mode" contact does not tend to disturb the surface flow of the developer powder. The image-bearing member preferably rotates at a surface speed of 50 to 200 millimeters per second.

For purposes of referring to relative motion between curved surfaces, the terms "with-mode" and "against-mode" are used in this specification and claims as known in the art. When the image-bearing member and the developer powder on the magnet roll are rotating in opposite directions, their adjacent curved surfaces move in the same direction. This condition is customarily referred to as "with-mode." By contrast, when the directions of rotation are the same, the adjacent curved surfaces move in opposite directions, referred to as "against-mode."

The doctor spacing g1 is preferred to be between 0.05 and 1.5 millimeters and the distance between the image-bearing member and the shell is preferably between 0.01 and 1.0 millimeters.

EXAMPLE 1

This example illustrates that excellent diffuse reflection density of a developed solid area is obtained by the process of this invention, using a single component relatively electrically conductive magnetic toner having an electric conductivity of about $10^{-3}$ mho.cm in a D.C. electrical field of 30 volts/cm. The apparatus used is depicted in FIG. 1. A zinc oxide-coated master paper was used as the image-bearing material of which the surface speed was 80 millimeters per second. The magnet roll used comprised an anisotropic barium ferrite magnet of 29.3 millimeter diameter and 250 millimeter length having eight symmetrically positioned poles and a stainless shell of 31.4 millimeter diameter and 250 millimeter length on which the magnetic flux density was about 1,100 gausses. The doctor gap g1 and the gap g3 were adjusted to be 0.8 and 0.7 millimeters, respectively.

When the magnet was rotated clockwise at a rate of 800 r.p.m. and the shell was rotated clockwise at a surface speed of 30 millimeters per second, the toner was conveyed at a rate of about 40 cubic millimeters per second per centimeter of lateral length of the shell and within one minute after the start of the rotation the accumulation reached about four millimeters and the accumulation became stable.

The zinc oxide coated master paper was uniformly to about −600 volts and developed to obtain a solid black image. The resultant image has a diffuse reflection density of 1.38 units.

EXAMPLE 2

In this example, the same apparatus as described in Example 1 was used with the exception of using a single component relatively highly resistive magnetic toner having an electric conductivity of about $10^{-12}$ mho.cm in a D.C. electrical field of 10,000 volts/cm. A solid black image was obtained by using the highly resistive magnetic toner in the same manner as described in Example 1 and was electrostatically transferred to a white plain paper sheet using a negative discharge. The transferred image was fixed on the sheet by passing through pressure-fixing rolls having a line pressure of 30 kilograms per centimeter. The resultant image had a diffuse reflection optical density of 1.32 units.

What is claimed is:

1. A process for developing latent electrographic images carried on an image carrier using magnetically attractable developer powder and a magnet roll, the powder flowing to the images through a first gap formed with the magnet roll, the magnet roll including a non-magnetic shell and a permanent magnet positioned within the shell, the shell and the magnet being independently rotatable, and the developer powder being attracted to the shell from a powder supply forming a second gap with the shell, the process comprising:

(a) transporting the attracted powder toward the first gap;

(b) forming an accumulation of the attracted powder on the surface of the shell in the vicinity of the first gap, both said transporting and forming steps being carried out by rotating the permanent magnet, the angular direction of said permanent magnet being such as to produce magnet peripheral motion away from the first gap and toward the supply;

(c) feeding a portion of the attracted powder in said accumulation into the first gap for developing the images; and (d) circulating the powder remaining in said accumulation, said circulating step including:

(i) establishing an understream of powder flowing toward said second gap and counter to the direction of, and underneath, the powder being transported from the supply, said understream being established by concurrently rotating the non-magnetic shell in the same angular direction as the permanent magnet but at slower angular speed, and (ii) transferring the powder flowing in said understream to the powder being transported from the supply, for stabilizing said accumulation.

2. The process as set forth in claim 1 wherein the permanent magnet member has a rotatable shaft mounted coaxially to the shell and a cylindrical permanent magnet secured to the shaft, the cylindrical permanent magnet having at least eight axially extending magnetic poles of alternating polarity on the peripheral surface thereof, the process further including the step of providing a magnetic flux density of at least 500 gauss.

3. The process as set forth in claim 1 wherein the permanent magnet member rotates at a rate of between 500 and 1,500 r.p.m. and the shell rotates at a surface speed of 30–60 mm/sec.

4. The process as set forth in claim 1 wherein the circulation of the accumulation is adjusted by the relative rotational speeds of the magnet and the shell for maintaining the contact of the developer powder with the surface of the image carrier for a period sufficient to allow an attraction force between the toner material of the developer powder and the electric pattern images on the surface to adhere the toner material to the images.

5. The process as set forth in claim 1 wherein the surface of the image carrier moves tangentially in a direction opposite to the direction of movement of surface of the shell at the point of contact of the image and the developer powder.

6. The process as set forth in claim 1 wherein the image carrier has an electroconductive backing plate and the non-magnetic shell is made of electroconductive material, the process further comprising the step of electrically grounding both the shell and the conductive backing plate.

7. The process as set forth in claim 1 wherein the image carrier has an electroconductive backing plate and the non-magnetic shell is made of electroconductive material, the process further comprising the step of applying an electrical potential between the shell and the conductive backing plate.

8. The process as set forth in claim 6 wherein the developer powder used in said attracting step is single component magnetic toner, the process further comprising adjusting the electric conductivity of said toner to range between $10^{-2}$ mho.cm in a D.C. electrical field of 30 volts/cm. and $10^{-5}$ mho.cm in a D.C. electrical field of 400 volts/cm.

9. The process as set forth in claim 7 wherein the developer powder used in said attracting step is single component magnetic toner, the process further comprising adjusting the electric conductivity of the toner to range between $10^{-2}$ mho.cm in a D.C. electrical field of 30 volts/cm and $10^{-5}$ mho.cm in a D.C. electrical field of 400 volts/cm.

10. The process as set forth in claim 6 wherein the developer powder used in said attracting step is single component magnetic toner, the process further comprising adjusting the electric conductivity of said toner to range between $10^{-8}$ and $10^{-14}$ mho.cm in a D.C. electrical field of 10,000 volts/cm.

11. The process as set forth in claim 7 wherein the developer powder used in said attracting step is single component magnetic toner, the process further including adjusting the electric conductivity of said toner to range between $10^{-8}$ and $10^{-14}$ mho.cm in a D.C. electrical field of 10,000 volts/cm.

12. The process as set forth in claim 1 further including setting said second gap to be larger than said first gap.

13. The process as set forth in claim 1 wherein said first gap is formed between the image carrier and the shell.

14. The process as set forth in claim 1 wherein said first gap is formed by a doctor blade adjacent the shell between the powder supply and the latent image.

* * * * *